US007096853B2

(12) United States Patent
Tomita

(10) Patent No.: US 7,096,853 B2
(45) Date of Patent: Aug. 29, 2006

(54) DIRECT FUEL INJECTION/SPARK IGNITION ENGINE CONTROL DEVICE

(75) Inventor: Masayuki Tomita, Fujisawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 11/038,620

(22) Filed: Jan. 21, 2005

(65) Prior Publication Data

US 2005/0161020 A1 Jul. 28, 2005

(30) Foreign Application Priority Data

Jan. 28, 2004 (JP) ..... 2004-020083
Jan. 28, 2004 (JP) ..... 2004-020085

(51) Int. Cl.
*F02P 5/00* (2006.01)
*F02P 5/145* (2006.01)

(52) U.S. Cl. ..... 123/406.47; 123/299

(58) Field of Classification Search ..... 123/406.47, 123/406.44, 406.53, 406.55, 299, 300, 295
See application file for complete search history.

(56) References Cited

U.S. PATENT DOCUMENTS 6,112,716 A 9/2000 Tachibana et al.
6,684,630 B1 * 2/2004 Uchida et al. ..... 60/284
6,725,649 B1 * 4/2004 Yamashita et al. ..... 60/284
6,772,585 B1 * 8/2004 Iihoshi et al. ..... 60/277
6,880,518 B1 * 4/2005 Shiraishi et al. ..... 123/295
6,895,933 B1 * 5/2005 Miwa et al. ..... 123/406.47
2003/0217733 A1 * 11/2003 Shiraishi et al. ..... 123/295

FOREIGN PATENT DOCUMENTS

EP 1108873 A 6/2001
JP 3325230 B2 9/2002
JP 2004-036461 A 2/2004
WO WO-2004/072461 A 8/2004

OTHER PUBLICATIONS

Ando et al., Mitsubishi GDI Engine Strategies to Meet the European Requirements, book, 1997, 55 & 55-70.

* cited by examiner

*Primary Examiner*—Mahmoud Gimie
(74) *Attorney, Agent, or Firm*—Global IP Counselors, LLP

(57) ABSTRACT

A control apparatus is configured to enhance turbulence in the cylinder produced by the fuel spray, and to improve combustion stability (promote flame propagation) in an ATDC designed to reduce HC and/or achieve early activation of the catalyst. Ignition timing is set to compression top dead center or later when for example the catalyst requires warming. In one fuel injection timing, a single fuel injection is injected prior to ignition timing at compression stroke top dead center or later. Alternatively, the fuel is injected in two fuel injections with a first fuel injection occurring during either the intake stroke or the compression stroke and the second fuel injection occurring at compression stroke top dead center or later.

20 Claims, 4 Drawing Sheets

DIRECT FUEL INJECTION/SPARK IGNITION ENGINE CONTROL DEVICE

CROSS-REFERENCE TO RELATED APPLICATIONS

This application claims priority to Japanese Patent Application Nos. 2004-20083 and 2004-20085. The entire disclosures of Japanese Patent Application Nos. 2004-20083 and 2004-20085 are hereby incorporated herein by reference.

BACKGROUND OF THE INVENTION

1. Field of the Invention

The present invention generally relates to a control device for a direct fuel injection spark ignition engine. More specifically, the present invention relates to a control device that is suitable during cold starting and the other times, or when it is necessary to warm up a catalyst for exhaust purification provided to the exhaust channel.

2. Background Information

One example of a direct fuel injection spark ignition engine with a fuel injection control is disclosed in Japanese Patent No. 3325230. This patent discloses a fuel injection control that is applied when the catalytic converter is in an un-warmed state, i.e., when the temperature of the catalyst is lower than its activation temperature. In this fuel injection control, the fuel injection is divided into at least two injection composed of an early-stage injection and a later-stage injection. Thus, an air-fuel mixture with a partially variable air-fuel ratio is formed in an interval that extends from the intake stroke to ignition timing. In the early-stage injection, fuel is injected prior to the later-stage injection such that an air-fuel mixture with an air-fuel ratio that is leaner than the theoretical air fuel ratio is generated to allow combustion to be extended using the fuel of the later-stage injection. The ignition timing is retarded by a predetermined amount from MBT. The ignition timing in the no-load region of the engine is set to occur prior to the compression top dead center; and ignition timing in the low-speed, low-load region, excluding the no-load region, of the engine is retarded until the compression top dead center or later.

In view of the above, it will be apparent to those skilled in the art from this disclosure that there exists a need for an improved control apparatus for a direct-injection spark-ignition internal combustion engine. This invention addresses this need in the art as well as other needs, which will become apparent to those skilled in the art from this disclosure.

SUMMARY OF THE INVENTION

It has been discovered that ignition timing delay is effective for promoting afterburning in order to reduce HC and achieve early catalyst warming when the engine is cold. Ignition (ATDC ignition) preferably occurs at compression top dead center or later to achieve an even greater effect, but the combustion interval must be shortened in order to carry out stable combustion with ATDC ignition. For this reason, the turbulence in the cylinder must be enhanced and combustion velocity (flame propagation velocity) increased. In view of the above, it is possible to consider generating turbulence in the cylinder using the fuel spray injected under high pressure.

In Japanese Patent No. 3325230, however, the first fuel injection (early-stage injection) is principally carried out in the intake stroke and the second fuel injection (later-stage injection) is carried out at 120 to 45° BTDC in the compression stroke, and even if turbulence is generated in the cylinder by the spray from the first fuel injection (early-stage injection) in the intake stroke, the turbulence weakens in the compression stroke and does not contribute to an increase in the flame propagation velocity at the ATDC ignition. Also even if turbulence is created in the cylinder when the final fuel injection (later stage injection) occurs prior to TDC, the turbulence weakens at TDC or later and does not contribute to the flame propagation speed during the ATDC ignition.

For this reason, the ATDC ignition is more effective in reducing HC and increasing the exhaust temperature. However, since combustion is not stabilized, the BTDC ignition is used in the no-load range as in the fuel injection control system of Japanese Patent No. 3325230.

In view of these facts, one object of the present invention is to improve the combustion stability in an ATDC ignition in order to reduce HC during cold starting and the other times and/or to activate the catalyst at an early stage.

In order to achieve the above mentioned object and other objects of the present invention, a direct fuel injection/spark ignition engine control device is provided that basically comprises a fuel injection control section and an ignition timing control section. The fuel injection control section is configured to control fuel injections of a fuel injection valve that directly injects fuel into a combustion chamber. The fuel injection control section is further configured to set an expansion stroke fuel injection timing including an extremely retarded fuel injection with an injection start timing and an injection end timing both occurring in an expansion stroke. The ignition timing control section is configured to control sparking of a spark plug disposed in the combustion chamber such that an ignition timing is set to ignite fuel at or after a compression top dead center and at least at or after the injection start timing.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
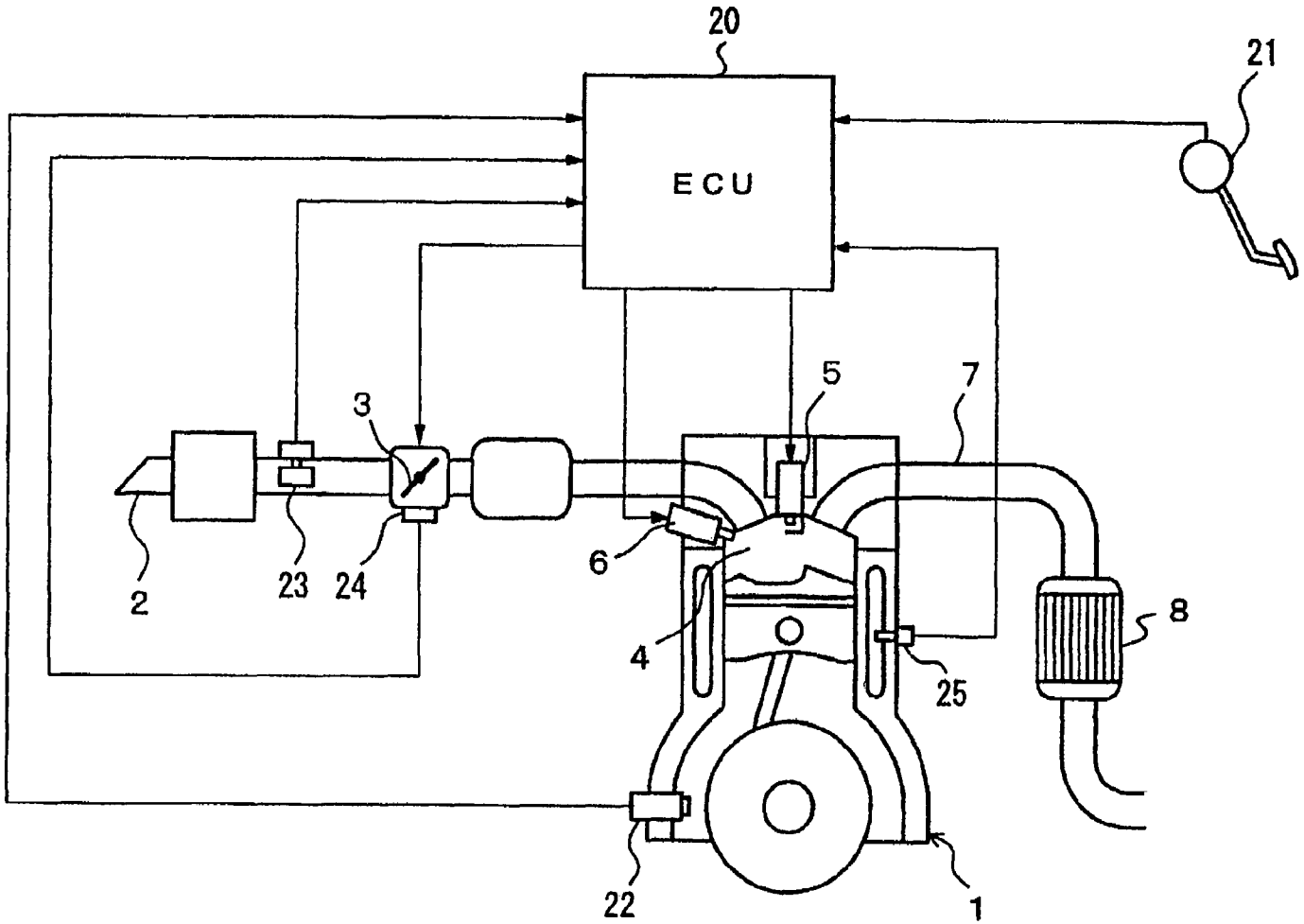
FIG. 1 is a diagrammatic view of an engine system illustrating a direct fuel injection/spark ignition engine control device for an internal combustion engine in accordance with the present invention.

Referring initially to FIG. 1, a direct fuel injection/spark ignition internal combustion engine 1 is diagrammatically illustrated that is equipped with a direct fuel injection/spark ignition engine control device in accordance with the present invention. The engine 1 has an intake passage 2 with an electronically controlled throttle valve 3 mounted therein. The electronically controlled throttle valve 3 is configured and arranged for controlling the intake air quantity to the intake passage 2 of the engine 1. The intake passage 2 is fluidly connected to a plurality of combustion chambers 4 (only one shown) of the engine 1. Each combustion chamber 4 includes a spark plug 5 and a fuel injection valve 6. The spark plug 5 and the fuel injection valve 6 are mounted to the combustion chamber 4 in a conventional manner. The engine 1 also has an exhaust passage 7 fluidly connected to each combustion chamber 4. The exhaust passage 7 includes a catalytic converter 8 with a catalyst for exhaust purification in a conventional manner.

The engine is controlled by an engine control unit or ECU 20 to perform the controlled combustion of the fuel air mixture as discussed below. Thus, the engine control unit 20 forms a direct fuel injection/spark ignition engine control device that includes a fuel injection control section and an ignition timing control section (see steps S2 and S3 of FIG. 2). In accordance with the present invention, the turbulence created in the intake or compression stroke weakens on the ATDC side, and flame propagation can be promoted during ATDC ignition by generating and enhancing the turbulence in the cylinder by fuel injection in the expansion stroke at TDC or later. Therefore, turbulence in the cylinder can be enhanced and the combustion stability can be improved when implementing ATDC ignition. Also implementing ATDC ignition in accordance with the present invention is effective to achieve early activation of the catalyst and a reduction in HC.

The engine control unit 20 is a microcomputer comprising of a central processing unit (CPU) and other peripheral devices. The engine control unit 20 can also include other conventional components such as an input interface circuit, an output interface circuit, and storage devices such as a ROM (Read Only Memory) device and a RAM (Random Access Memory) device. The engine control unit 20 preferably includes an engine control program that controls various components as discussed below. The engine control unit 20 receives input signals from various sensors (described below) that serve to detect the operating state of the engine 1 and executes the engine controls based on these signals. It will be apparent to those skilled in the art from this disclosure that the precise structure and algorithms for the engine control unit 20 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The opening of the electronically controlled throttle valve 3 is controlled by a stepping motor or other device operated by the signal from the engine control unit 20. Thus, the electrically controlled throttle valve 3 controls the intake air quantity or amount to the combustion chambers 4 of the engine 1 via the intake passage 2.

Each of the fuel injection valves 6 is configured so as to be opened by a solenoid energized by an injection pulse signal outputted from the engine control unit 20 in synchronization with the engine speed during an intake stroke or a compression stroke. Each of the fuel injection valves 6 injects fuel that is pressurized at a prescribed pressure. Thus, the fuel injected is distributed throughout the combustion chamber 4 such that a homogenous air/fuel mixture is formed in the case of an intake stroke injection, and a stratified air/fuel mixture is formed around the spark plug 5 in the case of a compression stroke injection. The air/fuel mixture is ignited by the spark plug 5 based on an ignition signal from the engine control unit 20, and is burned (homogenous combustion mode, stratified combustion mode).

The engine control unit 20 receives input signals from the following sensors: an accelerator pedal sensor 21, a crank angle sensor 22, a hot-wire airflow meter 23, a throttle sensor 24, and an engine coolant temperature sensor 25. The engine control unit 20 executes the engine controls including, but not limited to, the intake air quantity Qa, the ignition timing, the fuel injection quantity and fuel injection timing based on these signals.

The accelerator opening APO is detected by the accelerator pedal sensor 21, which outputs a signal to the engine control unit 20 that is indicative of the depression amount of the accelerator pedal. The engine speed Ne is detected by the crank angle sensor 22, which outputs a signal to the engine control unit 20 that is indicative of the engine speed Ne. The intake air quantity Qa is detected by the airflow meter 23, which outputs a signal to the engine control unit 20 that is indicative of the intake air quantity Qa. The throttle position TVO is detected by the throttle sensor 24, which outputs a signal to the engine control unit 20 that is indicative of the throttle position TVO. The engine coolant temperature or water temperature Tw is detected by the engine coolant temperature sensor 25, which outputs a signal to the engine control unit 20 that is indicative of the engine coolant temperature Tw.

The engine control unit 20 is configured to perform a selected combustion mode (homogenous combustion, stratified combustion) based on the engine operating conditions detected by these input signals, and control the opening of the electronically controlled throttle valve 3, the fuel injection timing and fuel injection quantity of the fuel injection valve 6, and the ignition timing of the spark plug 5 accordingly. Also, under normal operating conditions (after warming-up is completed), extremely lean stratified combustion is performed with an A/F ratio of about 30 to 40 (stratified lean combustion). Homogenous lean combustion (A/F=20 to 30) and homogenous stoichiometric combustion are included in homogenous combustion.

The present invention entails performing optimum combustion control according to load conditions when warming up is required for the catalyst in the catalytic converter 8, which includes cold starting. This type of control is performed by the engine control unit 20 as control from startup through warm-up of the catalyst in accordance with the flowchart in FIG. 2.

Figure 2:
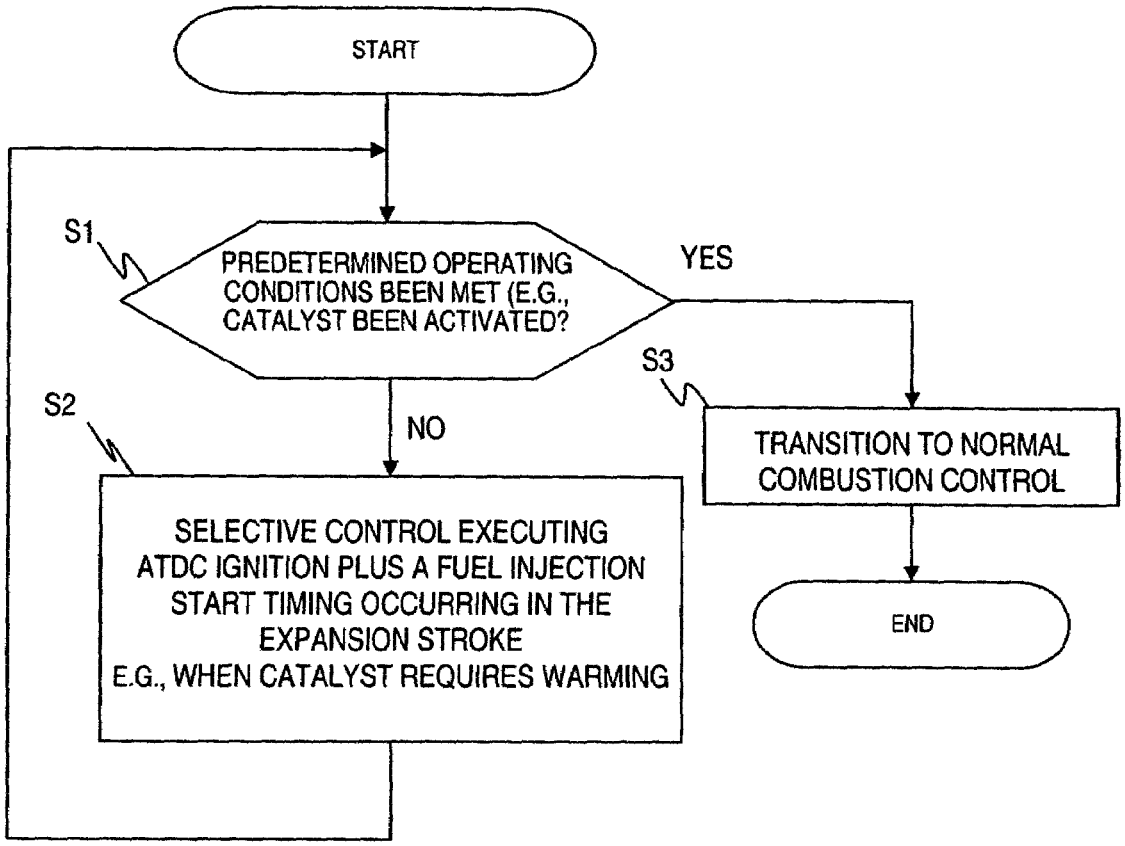
FIG. 2 is a flowchart showing the control operations executed from startup to during warm-up by the control unit of the direct fuel injection/spark ignition engine control device in accordance with the present invention.

The flowchart of in FIG. 2 will now be described, which shows control from startup through warm-up of the catalyst.

In step S1, a determination is made whether the catalyst of the catalytic converter 8 has been activated. Specifically, when a catalyst temperature sensor is provided, the catalyst temperature is detected thereby. When a catalyst temperature sensor is not provided, the catalyst temperature is estimated from the coolant temperature Tw that is detected by the engine coolant temperature sensor 25. The catalyst temperature can alternatively be estimated based on the coolant temperature at startup and the integrated value of the intake amount after startup. In any case, a determination is made whether the detected or estimated catalyst temperature is equal to or greater than the predetermined activation temperature. When the catalyst of the catalytic converter 8 has not been activated, the system advances to step S2.

In step S2, the ignition timing is delayed until compression top dead center (TDC) or later as the type of control performed when the catalyst requires warming. Specifically, the ignition timing is preferably set to between 15 and 30° ATDC (20° ATDC, for example) to perform ATDC ignition for Examples 1, 2 and 4 and is set to between TDC and 15° ATDC to perform ATDC ignition for Examples 3 and 4 to 8. The fuel injection timing is set to occur prior to ignition timing and at compression top dead center (TDC) or later, and is defined as expansion stroke injection (ATDC injection) that occurs at TDC or later. It should be noted that the fuel injection timing can be either a single injection in the expansion stroke or spilt into two fuel injections. If two fuel injections are used, then the first fuel injection occurs in either the intake stroke injection or the compression stroke injection and the second fuel injection occurs in the expansion stroke (ATDC injection). The details of fuel injection are described later. The air-fuel ratio in the combustion chamber produced by to the fuel injection (air-fuel ratio in the combustion chamber produced by the second fuel injection when the fuel injection has been divided into two occurrences) should be stoichiometric or slightly lean (A/F=16 to 17).

The system returns to step S1 after step S2 is complete. When the catalyst of the catalytic converter 8 has been activated by control when the catalyst requires warming, the system advances from step S1 to step S3 and transitions to normal control. In normal control, the above-described stratified lean combustion, homogenous lean combustion, stoichiometric combustion, and other types of combustion are carried out in accordance with the operating conditions.

Next, control performed when the catalyst requires warming will be described in more detail.

Ignition timing delay is effective for reducing HC and promoting catalyst warming when the engine 1 is cold, and ignition (ATDC ignition) preferably occurs at TDC or later. The combustion time is reduced in order to achieve stable combustion with ATDC ignition, and flame propagation produced by turbulence is therefore promoted.

Figure 3:
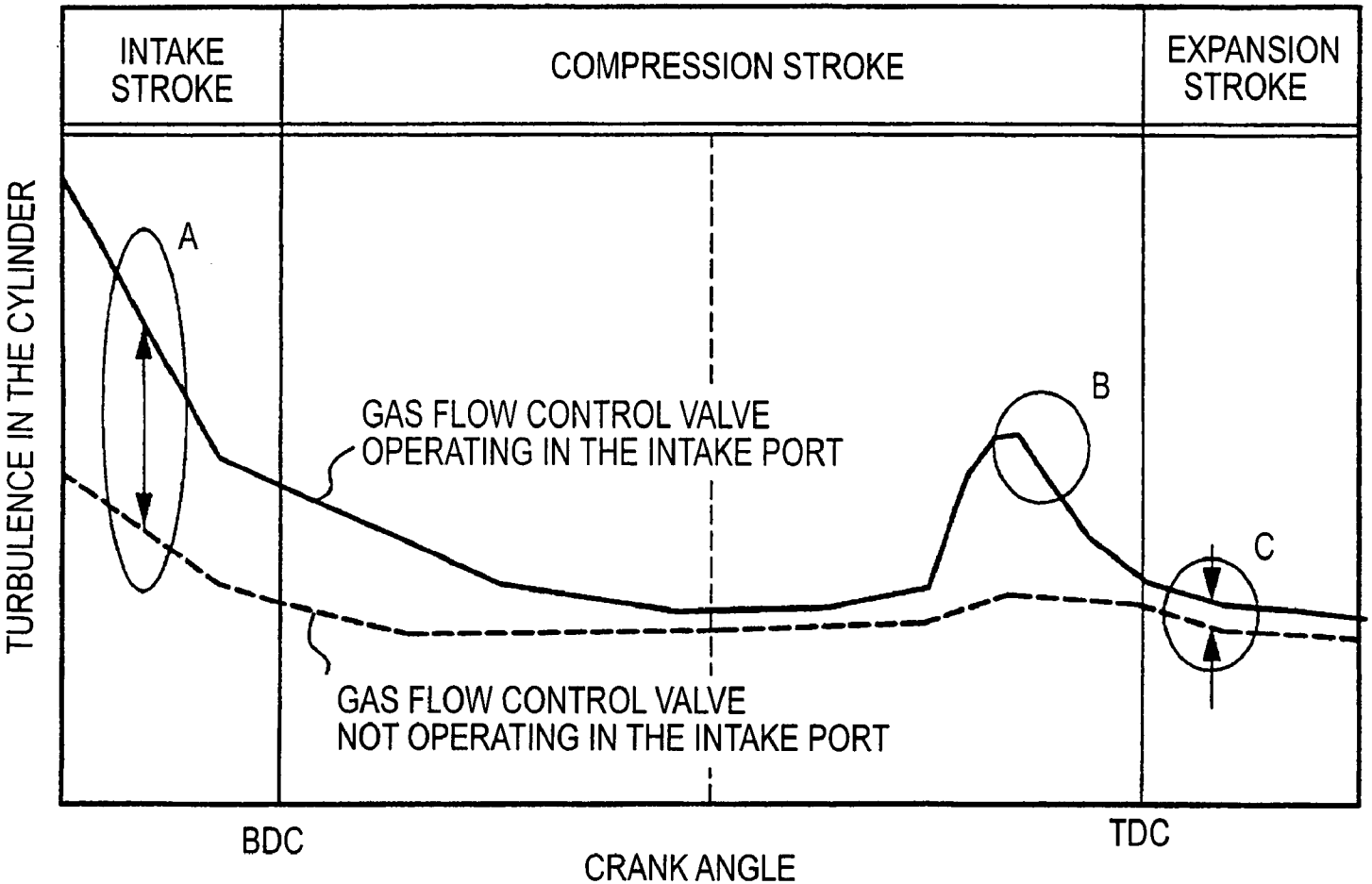
FIG. 3 is a graph showing the turbulence in the combustion chamber when a gas flow control valve housed in the intake port is used.

The turbulence at ignition timing or later is increased to promote flame propagation by operating a gas flow control valve (tumble control valve, for example) that is disposed in the intake port can be operated. It can be seen in FIG. 3 that the turbulence (point A) generated in the intake stroke weakens as the compression stroke progresses. Also even though turbulence is temporarily increased by eliminating (point B) the tumble flow produced by the piston in the second half of the compression stroke, the turbulence weakens at TDC or later (point C), and little improvement (improved flame propagation) in the combustion can be expected to be achieved using this turbulence. For this reason, it is possible to consider using turbulence produced by high-pressure fuel injection.

Figure 4:
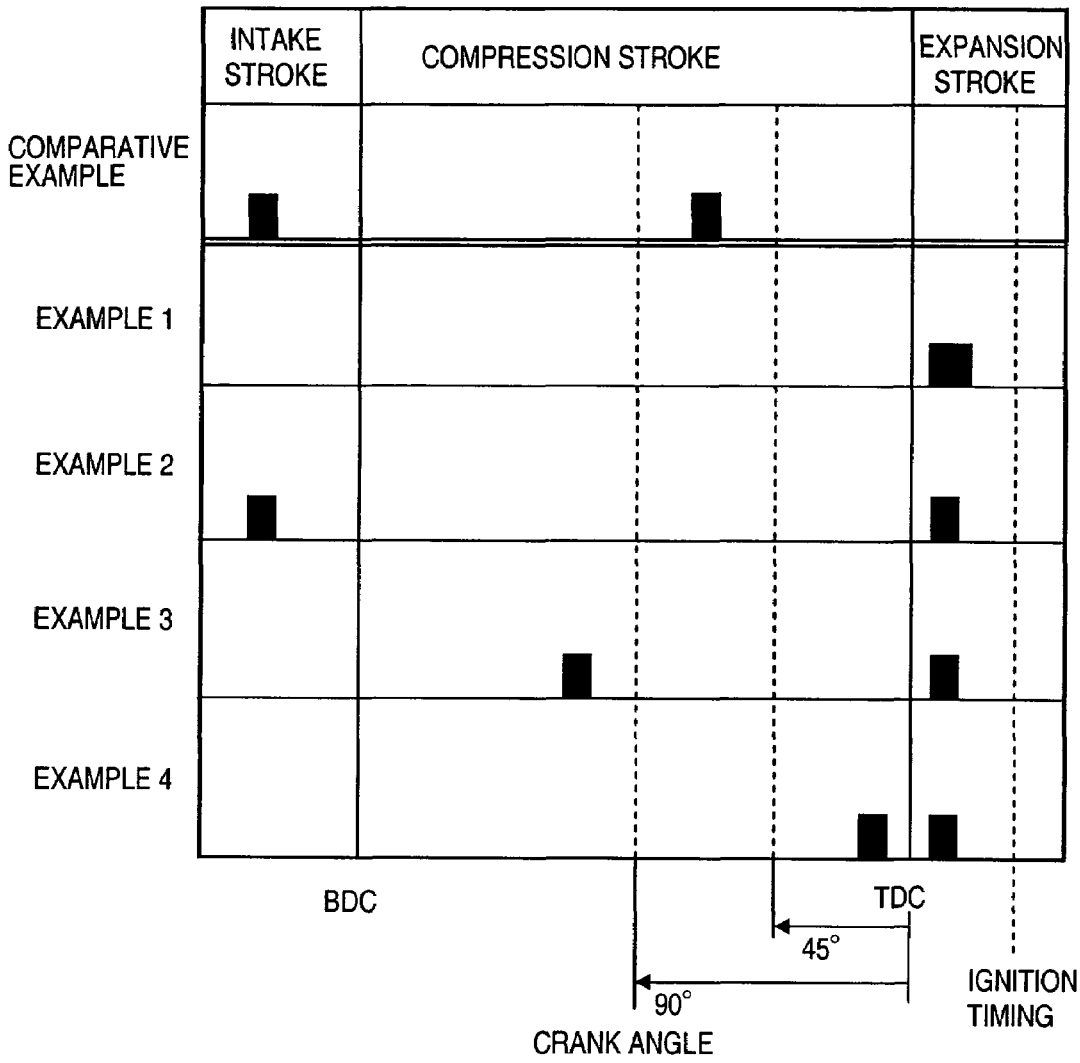
FIG. 4 is a fuel injection timing chart showing the fuel injections in accordance with a first embodiment of the present invention.

As shown in the Comparative Example of FIG. 4, when two fuel injections are executed with the first fuel injection being carried out during the intake stroke and the second fuel injection being carried out in the second half of the compression stroke (90 to 45° BTDC, for example), then the turbulence from the first fuel injection in the intake stroke weakens in the second half of the compression stroke. Thus, little effect is made on ATDC ignition even if a second fuel injection is performed in the second half of the compression stroke.

In view of the above, in the case of ATDC ignition of the present invention, at least one fuel injection occurs at TDC or later and the ignition timing (ATDC injection) starting at least at or after the last fuel injection start timing to enhance the gas flow at TDC or later and to improve combustion (improved flame propagation) during ATDC ignition by using the turbulence produced by high-pressure fuel injection.

Specifically, as shown in Example 1 of FIG. 4, a single expansion stroke fuel injection timing is used to create turbulence prior to ignition of the fuel in the combustion chamber 4. More specifically, fuel is injected into the combustion chamber 4 with an extremely retarded (expansion stroke) fuel injection occurring at the beginning or during the expansion stroke, i.e., an ATDC injection. The expansion stroke fuel injection has both its injection start timing and its injection end timing both occurring in the expansion stroke, i.e., at compression top dead center (TDC) or later and prior to ignition timing, as shown in Example 1 of FIG. 4. The ignition timing is set to between 15 and 30° ATDC (20° ATDC, for example) to perform the expansion stroke or ATDC ignition. Thus, the single expansion stroke fuel injection timing is at least completed before 30° ATDC.

In Example 2 of FIG. 4, fuel injection is divided into two fuel injections. In this example, a first fuel injection is carried out during the intake stroke, and the second fuel injection is carried out during the expansion stroke, i.e., an ATDC injection. Thus, when fuel is injected during the intake stroke by the first fuel injection prior to the ATDC injection (expansion stroke injection), the turbulence produced by the fuel injection weakens in the second half of the compression stroke and the gas flow enhancement is substantially unaffected during the expansion stroke or the ATDC ignition. In other words, in Example 2 of FIG. 4, injected fuel is dispersed throughout the combustion chamber 4, contributing to the promotion of afterburning produced by the ATDC ignition. This is therefore effective in reducing HC and increasing exhaust temperature.

In Example 3 of FIG. 4, the first fuel injection is further delayed from that of Example 2. Here, the first fuel injection has a fuel injection start timing and a fuel injection end timing that both occur in the first half of the compression stoke. The second fuel injection has a fuel injection start timing and a fuel injection end timing that both occur at or after the compression top dead center TDC, similar to Examples 1 and 2. Thus, the fuel of the second fuel injection is injected prior to ignition in the expansion stroke, allowing the turbulence in the combustion chamber 4 at ATDC startup to be further enhanced. Here, the first fuel injection is carried out in the first half of the compression stroke. However, greater turbulence can be obtained by carrying out the first fuel injection in the second half of the compression stroke since the turbulence begins to dissipate when the first fuel injection is carried out in the first half of the compression stroke.

In Example 4 of FIG. 4, fuel injection is divided into two fuel injections. In this example, a first fuel injection is carried out during the second half of the intake stroke, and the second fuel injection is carried out during the expansion stroke, i.e., an ATDC injection. Thus, when fuel is injected during the compression stroke prior to the ATDC injection (expansion stroke injection), the first or compression stroke fuel injection leaves behind greater turbulence than does the first intake stroke fuel injection of Examples 2 and 3 of FIG.

4. The turbulence produced by the first or compression stroke fuel injection is proportional to the delay in the weakening of turbulence produced by the fuel injection. Performing the second fuel injection at TDC or later can enhance turbulence so as to promote the turbulence generated by the first fuel injection. Thus, the second fuel injection at compression top dead center (TDC) or later can further enhance gas flow during the expansion stroke. In this case, the first fuel injection can be carried out in the first half of the compression stroke, but when the injection is carried out in the second half of the compression stroke (at 90° BTDC or later), turbulence can be further enhanced. In particular, when the first compression stroke injection is carried out at 45° BTDC or later, and more preferably at 20° BTDC or later, the gas flow at TDC or later can be further enhanced.

In accordance with the present embodiment of Examples 1 to 4, the ignition timing is set to ATDC when needed such as when the catalyst requires warming. Enhanced turbulence in the combustion chamber 4 is generated immediately prior to ignition by injecting fuel at TDC or later and prior to ignition timing. Also this enhanced turbulence in the combustion chamber 4 improves combustion stability (promotion of flame propagation) when implementing ATDC ignition to achieve early activation of the catalyst and to reduce HC.

In accordance with the present embodiment of Examples 1 to 4, an adequate afterburning effect can be obtained in order to achieve early activation of the catalyst and to reduce HC by setting the ignition timing to 15 to 30° ATDC. In other words, even if ignition timing is delayed to this extent, improved combustion can be achieved due to better flame propagation by delaying the point of turbulence generation and the fuel injection until immediately prior thereto.

In accordance with the present embodiment of Examples 1 to 4, the injected fuel can be dispersed throughout the combustion chamber by the time ignition occurs by injecting fuel prior to the fuel injection that occurs at TDC or later during the intake stroke, contributing to the promotion of afterburning produced by ATDC ignition. This approach is therefore effective in reducing HC and increasing exhaust temperature.

In accordance with the present embodiment of Examples 1 to 4, gas flow in ATDC (expansion stroke) can be further enhanced through the promotion of turbulence produced by the first fuel injection when injecting fuel during the compression stroke and prior to the second fuel injection that occurs at TDC or later.

In accordance with the present embodiment of Examples 1 to 4, the amount of oxygen required for afterburning can be adequately ensured by setting the air-fuel ratio in the combustion chamber 4 produced by the fuel injection(s) to be stoichiometric or slightly lean (A/F=16 to 17).

It should be noted that the fuel injection in ATDC of Examples 1 to 4 occurs prior to ignition timing, but since flame propagation advances together with time, the completion of fuel injection can be delayed beyond the ignition timing as long as it is synchronized with flame propagation.

As used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The term "detect" as used herein to describe an operation or function carried out by a component, a section, a device or the like includes a component, a section, a device or the like that does not require physical detection, but rather includes determining or computing or the like to carry out the operation or function. The term "configured" as used herein to describe a component, section or part of a device includes hardware and/or software that is constructed and/or programmed to carry out the desired function. Moreover, terms that are expressed as "means-plus function" in the claims should include any structure that can be utilized to carry out the function of that part of the present invention. The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A direct fuel injection/spark ignition engine control device comprising:

a fuel injection control section configured to control fuel injections of a fuel injection valve that directly injects fuel into a combustion chamber, the fuel injection control section being further configured to set an expansion stroke fuel injection timing including an extremely retarded fuel injection with an injection start timing and an injection end timing both occurring in an expansion stroke; and an ignition timing control section configured to control sparking of a spark plug disposed in the combustion chamber such that an initial ignition timing in a cycle is set at or after a compression top dead center and at least at or after the injection start timing.

2. The direct fuel injection/spark ignition engine control device according to claim 1, wherein the ignition timing control section is further configured to set the ignition timing between 15° CA and 30° CA after the compression top dead center.

3. The direct fuel injection/spark ignition engine control device according to claim 2, wherein the fuel injection control section is further configured to set an additional fuel injection so that a part of the additional fuel injection is injected in an intake stroke.

4. The direct fuel injection/spark ignition engine control device according to claim 2, wherein the fuel injection control section is further configured to set the expansion stroke fuel injection timing upon receiving a command to increase exhaust gas temperature.

5. The direct fuel injection/spark ignition engine control device according to claim 3, wherein the fuel injection control section is further configured to set the expansion stroke fuel injection timing upon receiving a command to increase exhaust gas temperature.

6. The direct fuel injection/spark ignition engine control device according to claim 3, wherein the fuel injection control section is further configured to set the expansion stroke fuel injection timing such that an average air-fuel ratio inside the combustion chamber is in an air-fuel ratio range between around stoichiometric and slightly lean during ignition.

7. The direct fuel injection/spark ignition engine control device according to claim 2, wherein the fuel injection control section is further configured to set the additional fuel injection so that a part of the additional fuel injection is injected in a compression stroke.

8. The direct fuel injection/spark ignition engine control device according to claim 7, wherein the fuel injection control section is further configured to set the fuel injection start timing for the additional injection at or after a beginning of a second half of the compression stroke.

9. The direct fuel injection/spark ignition engine control device according to claim 8, wherein the fuel injection control section is further configured to set the fuel injection start timing for the additional injection at or after 450° CA before the compression top dead center.

10. The direct fuel injection/spark ignition engine control device according to claim 7, wherein the fuel injection control section is further configured to set the expansion stroke fuel injection timing upon receiving a command to increase exhaust gas temperature.

11. The direct fuel injection/spark ignition engine control device according to claim 7, wherein the fuel injection control section is further configured to set the expansion stroke fuel injection timing such that an average air-fuel ratio inside the combustion chamber is in an air-fuel ratio range between around stoichiometric and slightly lean during ignition.

12. The direct fuel injection/spark ignition engine control device according to claim 2, wherein the fuel injection control section is further configured to set the expansion stroke fuel injection timing such that an average air-fuel ratio inside the combustion chamber is in an air-fuel ratio range between around stoichiometric and slightly lean during ignition.

13. The direct fuel injection/spark ignition engine control device according to claim 1, wherein the fuel injection control section is further configured to set an additional fuel injection so that a part of the additional fuel injection is injected in an intake stroke.

14. The direct fuel injection/spark ignition engine control device according to claim 1, wherein the fuel injection control section is further configured to set an additional fuel injection so that a part of the additional fuel injection is injected in a compression stroke.

15. The direct fuel injection/spark ignition engine control device according to claim 14, wherein the fuel injection control section is further configured to set the fuel injection start timing for the additional injection at or after a beginning of a second half of the compression stroke.

16. The direct fuel injection/spark ignition engine control device according to claim 15, wherein the fuel injection control section is further configured to set the fuel injection start timing for the additional injection at or after 45° CA before the compression top dead center.

17. The direct fuel injection/spark ignition engine control device according to claim 1, wherein the fuel injection control section is further configured to set the expansion stroke fuel injection timing upon receiving a command to increase exhaust gas temperature.

18. The direct fuel injection/spark ignition engine control device according to claim 1, wherein the fuel injection control section is further configured to set the expansion stroke fuel injection timing such that an average air-fuel ratio inside the combustion chamber is in an air-fuel ratio range between around stoichiometric and slightly lean during ignition.

19. A direct fuel injection/spark ignition engine control device comprising:

fuel injection controlling means for controlling fuel injections of a fuel injection valve that directly injects fuel into a combustion chamber, the fuel injection control controlling means being further configured to set an expansion stroke fuel injection timing including an extremely retarded fuel injection with an injection start timing and an injection end timing both occurring in an expansion stroke; and ignition timing controlling means for controlling ignition of a spark plug disposed in the combustion chamber such that an initial ignition timing in a cycle is set at or after a compression top dead center and at least at or after the injection start timing.

20. A method of controlling a direct fuel injection/spark ignition engine comprising:

controlling fuel injections of a fuel injection valve that directly injects fuel into a combustion chamber;

setting an expansion stroke fuel injection timing including an extremely retarded fuel injection with an injection start timing and an injection end timing both occurring in an expansion stroke; and controlling ignition of a spark plug disposed in the combustion chamber such that an initial ignition timing in a cycle is set at or after a compression top dead center and at least at or after the injection start timing.

* * * * *